United States Patent [19]

Shiurila

[11] 4,279,519

[45] Jul. 21, 1981

[54] DOT MATRIX PRINTING DEVICE EMPLOYING NOVEL IMAGE TRANSFER TECHNIQUE FOR PRINTING ON SINGLE PLY OR MULTIPLE PLY PRINT RECEIVING MEDIA

[75] Inventor: John Shiurila, Londonderry, N.H.

[73] Assignee: Centronics Data Computer Corp., Hudson, N.H.

[21] Appl. No.: 44,758

[22] Filed: Jun. 1, 1979

[51] Int. Cl.[3] ..... B41J 3/12; B41J 27/20

[52] U.S. Cl. ..... 400/124; 400/202.2; 400/471.1

[58] Field of Search ..... 400/124, 202.2, 470–471.1

[56] References Cited

U.S. PATENT DOCUMENTS

| | | | |
|---|---|---|---|
| 414,846 | 11/1889 | Smith | 400/471.1 |
| 2,530,697 | 11/1950 | Higgins | 400/470 |
| 3,400,801 | 9/1968 | Swenson | 400/202.2 |
| 4,027,766 | 6/1977 | Sargentini et al. | 400/470 |
| 4,153,378 | 5/1979 | Scherrer et al. | 400/202.2 |
| 4,165,188 | 8/1979 | Rempel | 400/124 |
| 4,194,846 | 3/1980 | Zerillo | 400/124 |

FOREIGN PATENT DOCUMENTS

| | | | |
|---|---|---|---|
| 2152241 | 4/1973 | Fed. Rep. of Germany | 400/124 |
| 2546835 | 4/1977 | Fed. Rep. of Germany | 400/124 |
| 2605559 | 8/1977 | Fed. Rep. of Germany | 400/470 |
| 2230176 | 12/1974 | France | 400/124 |
| 260872 | 4/1949 | Switzerland | 400/202.2 |

OTHER PUBLICATIONS

Lisinski, "Print Wire Inking System", IBM Technical Disclosure Bulletin, vol. 14, No. 10, p. 2980, 3/72.

Danwin et al., "Magnetic Method of Inking Print Wires", IBM Tech. Discl. Bulletin, vol. 18, No. 9, p. 2761, 2/76.

Lisinski et al., "Self-Inking Print Wires", IBM Technical Disclosure Bulletin, vol. 14, No. 9, p. 285, 2/72.

*Primary Examiner*—William Pieprz

*Attorney, Agent, or Firm*—Weinstein & Sutton

[57] ABSTRACT

A dot matrix impact printer having print wires reciprocating within a print head. A bearing guides printing tips in the nose of the print head. Liquid printing material stored within a container adjacent to the print head is delivered by a wick from the container to the sides of the print wires by capillary action. The liquid printing material works its way through the jewel bearing of the print head and on to the printing tips of the print wires whereupon it is transferred to the print receiving medium when impacted by the print wires. Porous absorbent members, adapted to expand upon wetting, engage the print wires at a location between said wick and said jewel bearing to regulate the flow of liquid printing material toward the printing tips to prevent dripping or dribbling of the liquid printing material from the print head and to prevent the liquid printing material from travelling along the print wires away from said jewel bearing and toward the print wire actuating means. The wick is mounted within a removable holder slidably inserted into the nose of the print head greatly facilitating assembly and disassembly of the apparatus for replacement of the disposable wick and facilitating removal of the porous absorbent members. A separator tool retains the wick in proper position preparatory to insertion of the holder. The disposable container is releasably mounted on a support adjacent to the print head nose and is easily removed and replaced.

30 Claims, 10 Drawing Figures

Figure 1A:
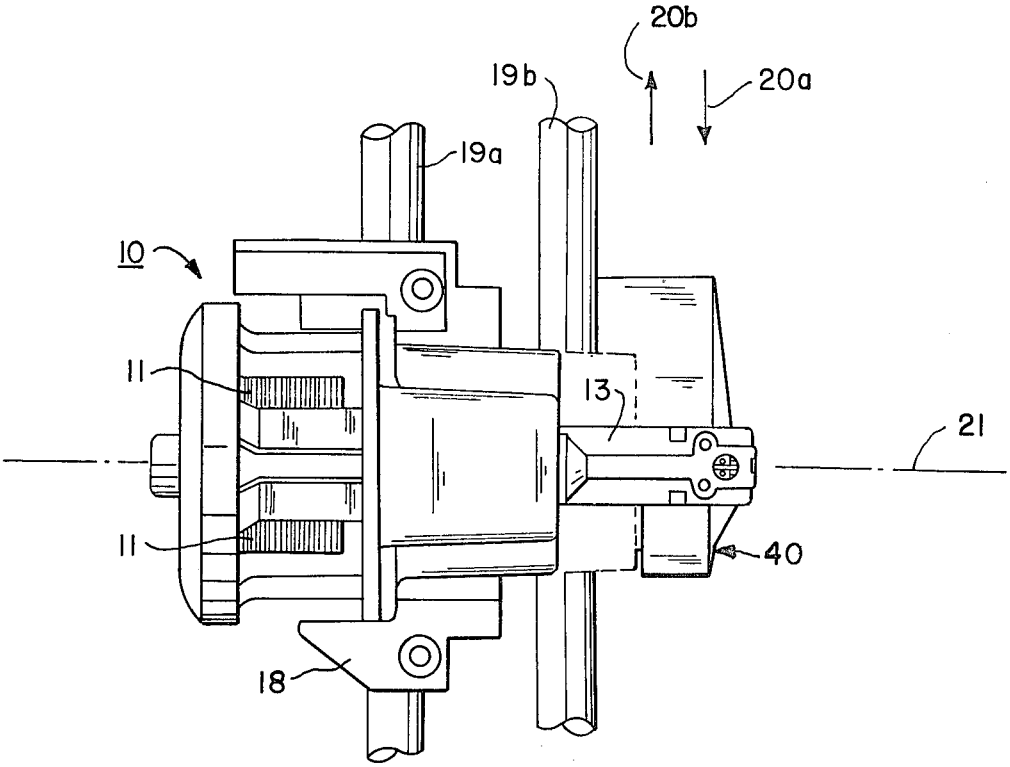

DOT MATRIX PRINTING DEVICE EMPLOYING NOVEL IMAGE TRANSFER TECHNIQUE FOR PRINTING ON SINGLE PLY OR MULTIPLE PLY PRINT RECEIVING MEDIA

BACKGROUND OF THE INVENTION

The present invention relates to printers and more particularly to dot matrix printers of the impact type utilizing means for directly inking the print wire tips as a greatly simplified alternative to the conventional technique of printing through the use of inked ribbons.

Dot matrix printers typically utilize liquid printing materials such as printing ink as the means for printing on a print receiving medium. The ink may either be applied to the print receiving medium by a technique in which the ink is propelled toward the print receiving medium, which technique is used in ink jet printers, or the ink may be transferred from a ribbon saturated with ink to the print receiving medium by impacting a printing element such as a print wire against the inked ribbon to transfer ink from the inked ribbon to the print receiving medium, forming printed data in the shape or contour of the surface portion of printing element striking the inked ribbon. The latter type of printers are typically referred to as impact type printers.

The disadvantages of the above printer designs are set forth in copending Ser. No. 901,182 filed Apr. 28, 1978, now U.S. Pat. No. 4,194,846, issued Mar. 25, 1980 and assigned to the assignee of the present application. The disadvantages of the above printer designs pointed out in the abovementioned U.S. Pat. No. 4,194,846 have led to the development of a printing device as described in said patent which is adapted to deliver liquid printing material from a container to be directed to the tips of the print wires which transfer the liquid printing material to a print receiving medium when said tips impact against said print receiving medium. Although this design eliminates the disadvantages encountered in ink jet printers and encountered in printers using conventional inked ribbons, it has been found that the apparatus described by the said U.S. Pat. No. 4,194,846 lacks the ability to accurately regulate the amount of ink delivered to the print wires which leads to dripping and smudging of the ink resulting in an overall degradation in print quality. In addition, it has been found that the ink in the apparatus of the abovementioned U.S. Pat. No. 4,194,846 dries out prematurely, making the design both impractical and uneconomical.

BRIEF DESCRIPTION OF THE INVENTION

The present invention avoids all of the disadvantages of the prior art apparatus while providing a highly simplified ink feeding arrangement whose design greatly facilitates ease of manufacture as well as assembly and/or disassembly of the apparatus.

The inking system of the present invention, although usable in a wide variety of printing applications, is especially adapted for use with dot matrix print heads of the impact type and is characterized by comprising two fiber wicks arranged within a easily removable wick holder which further cooperates with an opening in the print head to retain a pair of compressed, porous sponge-like absorbent elements arranged forwardly of the aforementioned pair of wicks, said wicks and said absorbent elements being placed on opposite sides of the group of print wires. The entire assembly, including the wick holder, is mounted within an opening provided in the nose of the print head so that the pair of wicks depend downwardly and extend at least partially below the underside of the print head. A disposable replaceable ink supply container is resiliently supported within a mounting bracket and includes a container wick which delivers ink in the container upwardly by capillary action along the container wick. The upper end of the container wick is exposed through an opening provided at the top surface of the disposable container and is pressed against the lower ends of the aforesaid pair of print head wicks whereby ink is transferred to the print head wicks and is then fed upwardly by capillary action through the print head wicks to the print wires.

The wick holder presses the print head wicks into intimate sliding engagement with the sides of the print wires at a region adjacent to the print head front bearing which maintains the printing tips of the print wires in alignment and preferably in a linear array. Ink carried upwardly by the aforesaid capillary action is deposited along the sides of the print wires and is caused to move along the print wires toward the printing tips.

The forward end of the wick holder supports a pair of porous compressible absorber members arranged in a region between the bearing of the print head and the print head wicks. The ink absorber members are slideablly engaged by the print wires and absorb ink collected thereon. The absorber members, when wetted, expand by a significant amount to be retained in position and serve to regulate the amount of ink delivered to the print wire tips as well as serving as an auxiliary ink reservoir due to their large absorbent capabilities thereby enabling the performance of high speed printing without dripping of the ink.

The ink moves forward into the region between the exterior surfaces of the forward ends of the print wires and the openings in the print head bearing which maintains the forward ends of the reciprocating print wires in proper alignment. The ink feeds into this small annular region by capillary action and works its way forward to become deposited upon the forwardmost surfaces or printing tips of the print wires whereupon the ink is transferred to the print-receiving medium when the print wires are impacted against said medium.

The mounting bracket for the disposable ink container permits the container to be removed and replaced without altering the position of the print head. An L-shaped guiding recess cooperates with a projection along the front face of the disposable ink container to assure proper alignment of the disposable ink container upon the container mounting bracket, thereby assuring precise alignment of the container wick with the print head wicks.

A small separator tool, having a rectangular cross-sectional configuration, is adapted to be inserted into the wick holder to maintain the print head wicks in proper alignment within recesses in the wick holder on opposite sides of the print head wires so as to greatly facilitate installation of wicks into the print head.

The container is provided with alignment means arranged within the container interior for properly orienting the container wick and preventing the container wick from experiencing any undesirable motion during movement of the print head by the carriage assembly in the performance of a printing operation. The container is shaped to conform to the neighboring geometry of the print head and carriage assembly so as to take maximum advantage of available space to optimize the amount of ink being provided and thereby minimize the number of ink container replacement operations required.

A paper guide member is fitted upon the front end of the print head nose and is provided with runners in the shape of a frame which is adapted to slideably engage the print-receiving medium as the print head moves across a paper supporting platen in order to prevent freshly-printed characters from being smeared, as well as preventing ink collected upon the front face of the bearing from being transferred to the print-receiving medium and thereby smudging the aforesaid medium so as to cause a degradation in print quality.

OBJECTS OF THE INVENTION AND BRIEF DESCRIPTION OF THE FIGURES

It is therefore one object of the present invention to provide a novel ink delivery system for printing assemblies and the like which system is distinguished by its ease of assembly and disassembly.

Still another object of the present invention is to provide a novel ink delivery system for use with printing assemblies and the like and which system is distinguished by its ability to print characters and other indicia of good quality and sharp contrast at high speed without smudging or smearing.

Still another object of the present invention is to provide a novel ink delivery system for printing assemblies and the like which is comprised of a removable assembly incorporating a holder and wicking elements for delivering ink in a reliable manner from a supply container to the reciprocating printing elements of the printing assembly.

Still another object of the present invention is to provide a novel ink delivery system for use with printing assemblies and the like in which wicking means are provided for delivering ink from an ink supply container to the reciprocating printing elements and further including ink absorbing means for regulating the quantity of ink deposited upon the print-receiving medium during printing, enabling printing at high speeds without dripping or smearing.

Still another object of the present invention is to provide a novel ink delivery system for use with printing assemblies and the like in which ink delivery wicking means and ink supply regulating means are mounted upon a holder to facilitate assembly and disassembly of the ink delivery system.

Still another object of the present invention is to provide a novel ink delivery system for printing assemblies and the like comprising a novel spring-loaded ink supply container bracket assembly for resiliently mounting and aligning the ink supply container to assure proper alignment of the ink container wick with the print head wicks.

Still another object of the present invention is to provide a novel ink delivery system for printing assemblies and the like comprising novel disposable container means having mounting means for supporting and aligning the container wick to prevent unnecessary movement of the container wick during operation of the movable printing assembly.

Still another object of the present invention is to provide a novel ink delivery system for printing assemblies and the like comprising a novel paper guide mounted upon the nose of the print head to prevent the print-receiving medium from engaging the forward surface of the printing assembly so as to avoid undesirable transfer of ink from the printing assembly to the print-receiving medium, thereby eliminating smudging or smearing.

Figure 2:
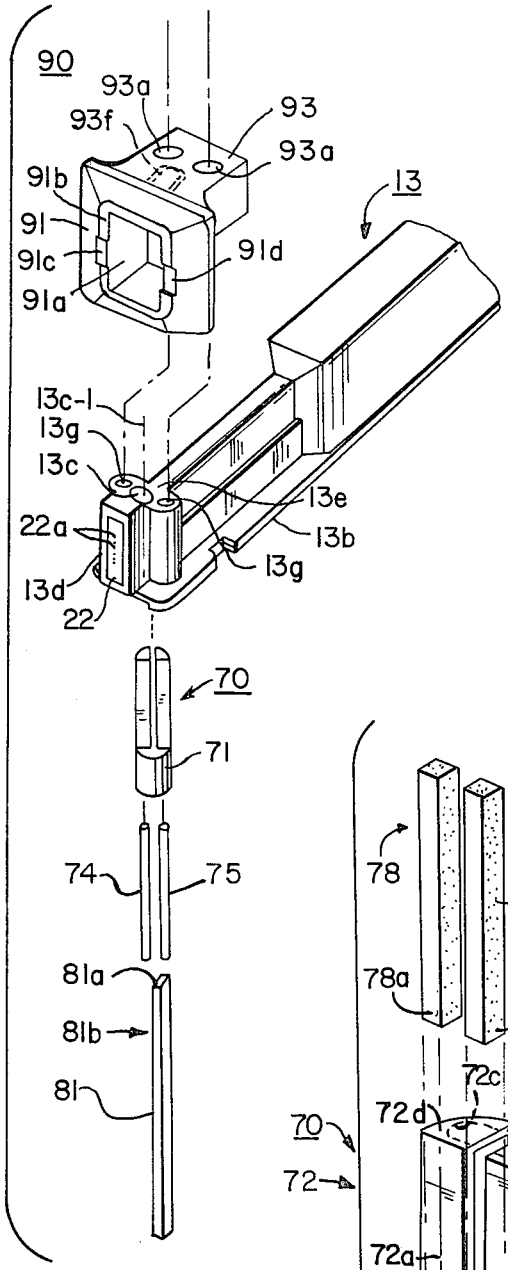

The above, as well as other objects of the present invention, will become apparent when reading the accompanying description and drawings in which:

FIG. 1*a* is a top plan view of a print head assembly embodying the principles of the present invention and with the paper guide member of FIG. 2 being removed from the print head assembly.

Figure 1B:
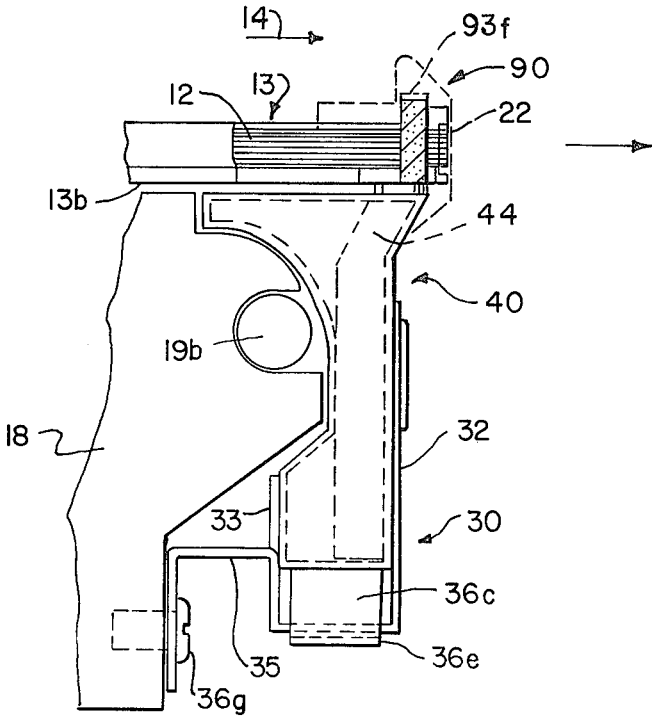

FIG. 1*b* shows a side elevational view of the assembly of FIG. 1*a*.

FIG. 2 shows an exploded detail perspective view of the portion of the ink delivery assembly mounted within the nose of the print head assembly.

Figure 2A:
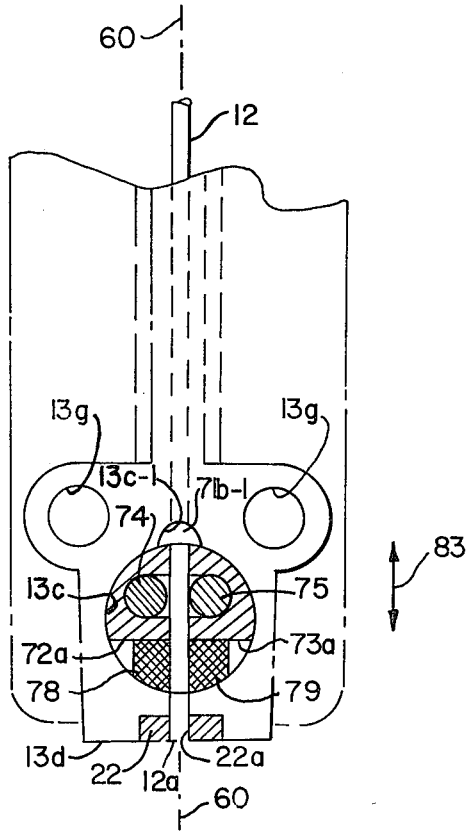

FIG. 2*a* shows a top plan view of the ink delivery assembly of FIG. 2 when assembled within the nose portion of the print head.

Figure 2B:
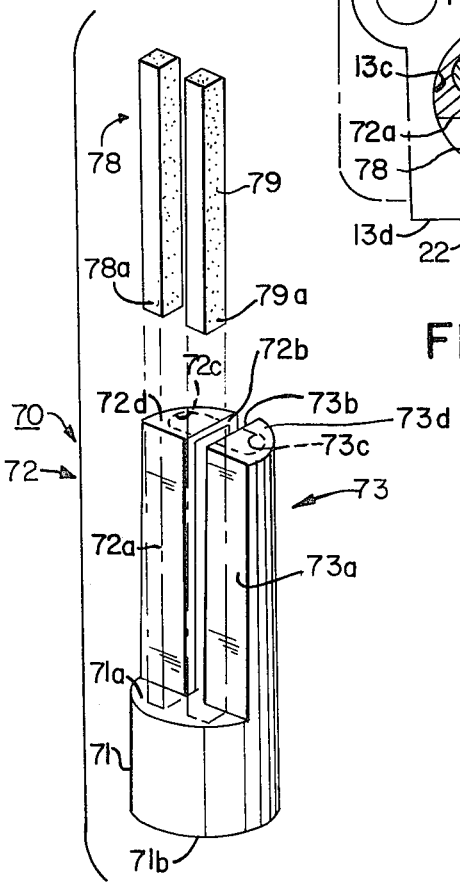

FIG. 2*b* shows a detailed perspective view of the holder member of FIG. 2.

Figure 3A:
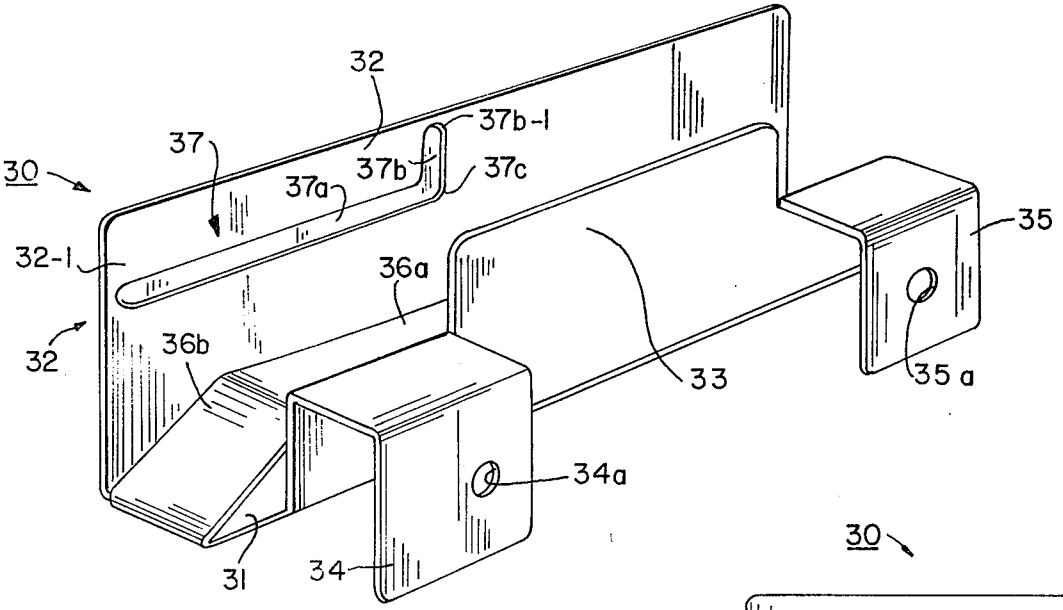

FIG. 3*a* shows a perspective view of the container mounting assembly of FIG. 1*b*.

Figure 3B:
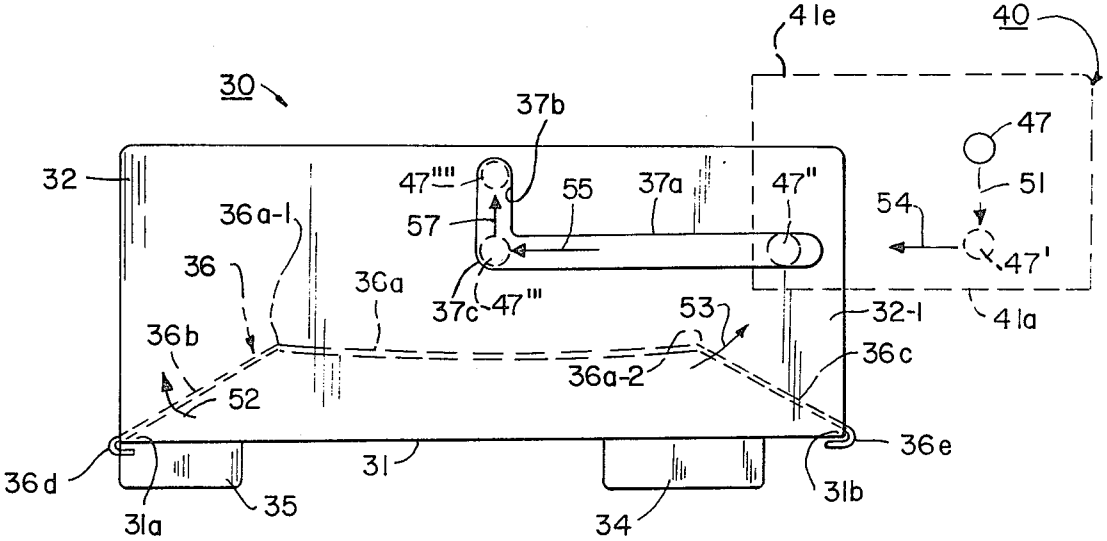

FIG. 3*b* shows a front elevational view of the bracket of FIG. 1*d*.

Figure 3C:
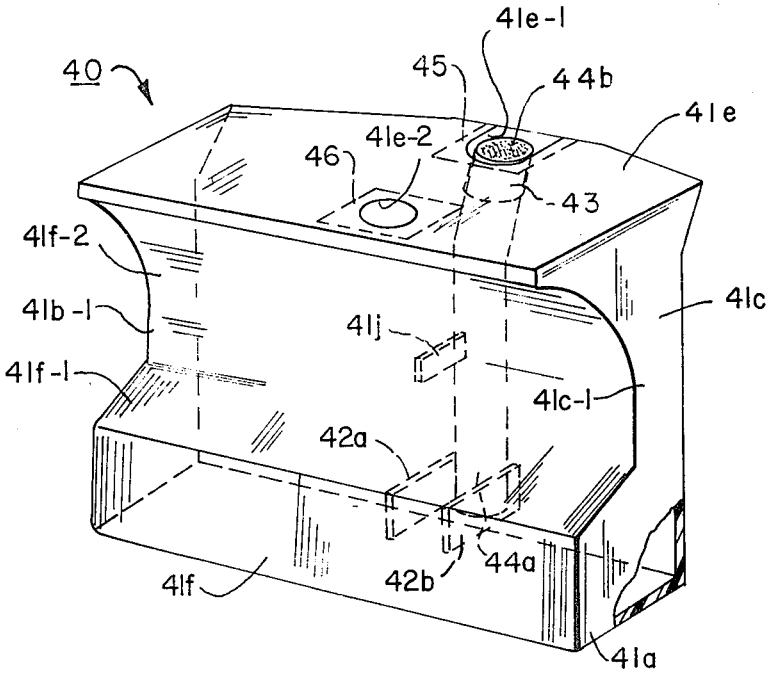
Figure 3D:
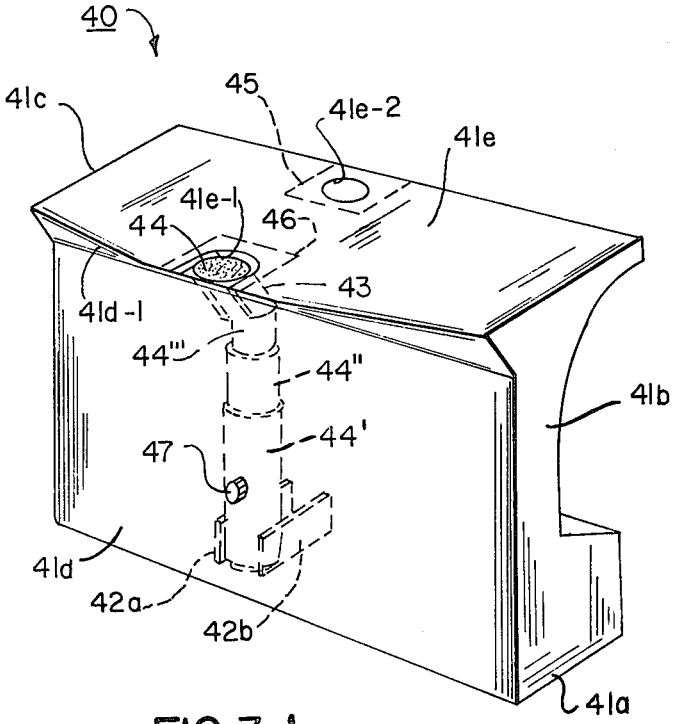

FIGS. 3*c* and 3*d* show front and rear perspective views respectively, of the container of FIGS. 1*a* and 1*b*.

Figure 4:
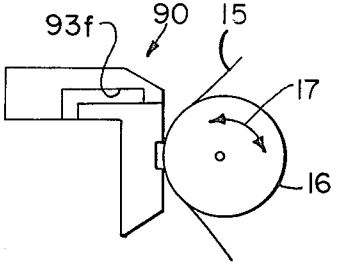

FIG. 4 shows a side elevational view of a portion of the print head assembly of FIG. 1*a* showing the manner in which the paper guide member of FIG. 2 maintains the print-receiving medium displaced from the front face of the print head to prevent undesirable smearing or smudging.

DETAILED DESCRIPTION OF THE INVENTION INCLUDING THE PREFERRED MODE FOR CARRYING OUT THE INVENTION

FIGS. 1*a* and 1*b* show a print head 10 of the dot matrix impact type. The print head 10 is preferably of the type described in copending application Ser. No. 772,459, filed Feb. 28, 1977 now U.S. Pat. No. 4,165,940 issued Aug. 28, 1979, and assigned to the assignee of the present invention. The print head 10, typically referred to as a print head of the free-flite type, is comprised of a plurality of electromagnet structures 11 arranged to selectively urge their associated print wires 12, arranged within a nose cone member 13, to be moved rapidly in the forward or printing direction, as shown by arrow 14, in order to be impacted against a print-receiving medium 15 (see FIG. 4) which may, for example, be a continuous elongated paper web 15 of indeterminate length, said paper web 15 being supported by a platen 16 (FIG. 4), which may be adapted to rotate in the clockwise direction, as shown by arrow 17 to advance the paper web 15 in order to perform a "line feed" operation. Obviously, the platen 16 may be adapted to rotate in the reverse direction, either for removal of the paper web 15, for reprinting on an already printed line or for any other purpose.

The print head assembly 10 is mounted upon a carriage 18 (FIG. 1*a*) which is slideably guided by a pair of guide shafts 19*a* and 19*b* mounted in spaced parallel fashion on the printer frame (not shown) to facilitate movement of the print head 10 in the forward printing direction, shown by arrow 20*a*, and the rearward printing direction or "carriage return" direction, shown by arrow 20*b*.

The rear ends of print wires 12 cooperate with armature members (not shown) forming part of the electromagnet assemblies 11 and extend forwardly through the nose cone member 13 where all of the print wires 12 merge so that their front tips are aligned along a vertical imaginary line represented by center line 21 of FIG. 1*a*. This alignment is maintained by means of a bearing 22 shown best in FIGS. 2 and 2*a*, which bearing may, for example, be a jewel bearing, such as a ruby or sapphire member having a plurality of openings 22*a*, each being adapted to receive and align one of the reciprocating print wires 12. The bearing 22 may also be formed from a suitable plastic material in some applications.

In contrast to conventional printers, the need for an inked ribbon has been eliminated and has been replaced by the novel ink delivery system of the present invention which is comprised of an ink container assembly 40 releasably mounted within a container mounting assembly 30, the container 40 being shown best in FIGS. 3*c* and 3*d* and the container mounting bracket assembly 30 being shown best in FIGS. 1*b*, 3*a*, and 3*b*.

Although the container 40 is admittedly of an unusual, i.e., non-regular shape, the container 40 has been configured in this manner in order to best fit the surrounding geometry of the print head 10 and carriage assembly 18 so as to make maximum use of the available space in order to maximize the amount of liquid printing material capable of being stored therein.

Considering FIGS. 1*b*, 3*a*, and 3*b*, it can be seen that the container mounting assembly 30 is comprised of a substantially U-shaped bracket having a central or yoke portion 31, a longer front upright arm 32, and a shorter upright rear arm 33, both arms 32 and 33 being integral with the yoke portion 31 of the bracket. A pair of mounting portions 34 and 35 is integral with upright shorter arm 33 which is cut and bent so as to form the mounting surfaces having openings 34*a* and 35*a*, each adapted to receive threaded fastening members, such as, for example, threaded fastener 36*g*, shown in FIG. 1*b*, in order to mount the container bracket assembly 30 to the front wall of carriage assembly 18.

A biasing spring 36 is positioned upon the upper surface of yoke member 31 and is provided with a central substantially flat portion 36*a* having a pair of arms 36*b* and 36*c* integral with said central portion 36*a* and bent downwardly and outwardly so as to be diagonally aligned, as shown best in FIGS. 3*a* and 3*b*. The free ends of arms 36*b* and 36*c* are bent inwardly, as shown at 36*d* and 36*e*, respectively, so as to embrace the opposing edges 31*a* and 31*b* of the yoke portion 31 of bracket 30. The longer upright wall 32 is provided with a substantially L-shaped recess or depression 37 which is comprised of a horizontally-aligned portion 37*a* merging with a vertically-aligned portion 37*b* at knee 37*c*.

The container 40 is shown in detail in FIGS. 3*c* and 3*d* and is preferably formed of an inexpensive disposable plastic material capable of being inexpensively injection molded, for example, although any other fabrication process may be employed. The plastic material and the thickness of same is chosen to withstand fracture experienced during normal handling and to withstand chemical erosion due to the erosive characteristics of constituents within the liquid printing material. The container 40 has a base portion 41*a*, upright sidewalls 41*b* and 41*c*, a rear wall 41*d*, a top surface 41*e*, and a front wall 41*f*. The upper portion 41*d*-1 of rear wall 41*d* extends diagonally upwardly and outwardly so as to further increase the total interior volume and, as was noted hereinabove, takes maximum advantage of the surrounding geometry to optimize the ink storage capacity of the container 40.

The front wall has a vertically-aligned lower portion 41*f*, a mid portion 41*f*-1 which extends diagonally inward and upward therefrom, and a substantially curved upper portion 41*f*-2 which curves upwardly and outwardly to meet the adjacent edge of top surface 41*e*. Although the shape of container 40 is rather unusual, it should be understood that any other shape may be utilized, depending upon the geometry of neighboring components within the particular printer, it being understood that efforts to maximize the size and hence ink storage capacity of the container 40 serve to reduce the number of times the container 40 has to be removed and replaced to effect printing operations.

The lower portion of the inner surface of rear wall 41*d* is provided with a pair of integral, spaced parallel projections 42*a* and 42*b* extending toward, but not quite touching, the inner surface of front wall portion 41*f*.

The central portion of the inner surface of rear wall 41*d* is provided with at least one integral projection 41*j* which preferably touches the inner surface of opposite wall portion 41*c*-1 to prevent the container 40, which is preferably formed of a resilient material, from collapsing or being squeezed to compress the container 40, thereby preventing the ink from being accidentally dispensed from container 40.

The top surface 41*e* is provided with a substantially U-shaped opening 41*e*-1. A substantially U-shaped collar or guide member 43 is arranged below top surface 41*e* and is formed integral with top surface 41*e* and diagonally-aligned rear surface portion 41*d*-1 so as to form a guide means for receiving and positioning a container wick 44. The wick 44 is a substantially elongated cylindrical-shaped member, preferably formed of a bonded, compressed cellulose acetate material which is a substantially semi-rigid element inserted into opening 43 and bent due to the narrow constricted portion 41*c*-1 and 41*b*-1 of the sidewalls 41*c* and 41*b*. The container wick 44 is of a length sufficient to extend to floor 41*a* and is pushed in completely so that its lower end 44*a* is embraced between projections 42*a* and 42*b*. The constricted neck portion of the container 40 in the regions 41*c*-1 and 41*b*-1, the projections 42*a* and 42*b*, and the collar 43 serve to retain the container wick 44 from experiencing any undesirable movement or swaying which might otherwise occur as a result of the continuous reciprocating movement of the print head 10 and carriage 18, so as to assure good firm engagement between the upper surface 44*b* of container wick 44 and the lower ends of the print head wicks 74 and 75 which will be more fully described hereinbelow. The dimensional relationships between the projections 42*a* and 42*b*, the narrow neck portion of the container, and the collar 43, relative to the diameter of the container wick 44, is such as to provide a slip fit when the container wick is first inserted. After insertion, the container is filled with liquid printing material, such as printing ink, by inserting the ink through second opening 41*e*-2 in the top surface 41*e* of container 41. The container wick 44 becomes saturated with the printing ink and experiences some expansion, thereby further improving the tightness of the fit of container wick 44 within the container assembly 40. Although efforts have been made to prevent the container wick 44 from experiencing unnecessary movement or swaying, it should be noted that the continuous movement or sloshing of the ink within container assembly 40 during the constant reciprocating movement of the print head 10 is advantageous, as it enhances the homogenity of the constituents of the printing ink, as well as preventing drying of the ink. The printing ink container 40 may be stored without fear that the liquid contents will dry out or spill by placing pressure-sensitive adhesive tabs in a sealing position over each of the openings 41*e*-1 and 41*e*-2, said tabs 45 and 46 being represented in dotted fashion in FIGS. 3*c* and 3*d*.

The front wall 41*d* is provided with a substantially circular-shaped projection 47 extending outwardly and away from the lower sidewall portion 41*d*, which projection 47 cooperates with the L-shaped recess 37 in the resilient mounting bracket assembly 30 for assuring precise alignment of the container assembly 40 within the mounting bracket 30 to thereby assure precise alignment of container wick 44 with the print head wicks 74 and 75 which will be more fully described hereinbelow.

The container assembly 40 is mounted within the resilient mounting assembly in the following manner:

Making reference to FIG. 3b, the printing ink container 40 is positioned so that projection 47 is facing upright arm 32 of bracket assembly 30. The left-hand end of the container assembly 40, relative to FIG. 3*b*, is partially inserted into the region between upright arms 32 and 33, so that its lower surface 41*a* engages the top of resilient spring 36. The container 40 is moved downwardly, as shown by arrow 51, thereby moving projection 47 to the position shown at 47′. The downward movement urges resilient spring 36 downwardly, causing central portion 36*a* to "bow" and arms 36*b* and 36*c* to bend outwardly relative to central portion 36*a*, as shown by arrows 52 and 53. The container 40 is moved downwardly, as shown by arrow 51, so that projection 47 occupies a position 47′ which is substantially aligned with the horizontal portion 37*a* of L-shaped container guiding recess 37. Thereafter, container 40 is moved to the left, as shown by arrow 54, so that the container moves between upright arms 32 and 33, and the projection 47′ first engages the portion 32-1 of arm 32 immediately adjacent the left-hand end of horizontally-aligned recess 37*a*, and thereafter the projection moves to the position 47″ where it enters into the right-hand end of recess portion 37*a*.

The container 40 is moved further to the left, as shown by arrow 55, to the point where the projection moves to the dotted line position 47‴, at which point the projection 47 has entered into the knee 37*c* of L-shaped recess 37, which knee portion 37*c* communicates with both the horizontal-aligned recess portion 37*a* and the vertically-aligned recess portion 37*b*. At this time, the container 40 is now substantially aligned within the bracket assembly 30, so that wick 44 is positioned directly beneath that portion of the nose of print head 10 which houses the print head wicks 74 and 75, which will be more fully described hereinbelow. The container 40 may then be released, whereupon the potential energy previously imparted to spring 36 urges the container 40 upwardly in the direction shown by arrow 57. The amount of upward movement of projection 47 in recess 37*b* is limited by virtue of the fact that the top surface 41*e* of container 40 strikes against the under surface 13*b* of nose cone 13, preventing the container from experiencing any further upward movement. The upper end of recess 37*b* is designed to accommodate a wide tolerance in the location of the under surface 13*b* of the nose cone 13. The projection 47 is retained within the vertically aligned recess portion 37*b* by virtue of the fact that the container 40 is embraced between the upright walls 32 and 33 with minimal clearance, thereby preventing the projection 47 from being released from the vertically-aligned recess portion 37*b*. The bends 36*a*-1, 36*a*-2 of spring 36 engage and support the bottom surface 41*a* of container 40 to provide a self-adaptive levelling of container 40.

It should be obvious that removal of an exhausted container 40 from the mounting assembly 30 may be carried out simply by pressing down upon the top surface 41*e* of container assembly 40 and then to the right so as to reverse the direction of movement and order of steps undertaken during insertion of a fresh container 40. The spring element 36 is provided with sufficient resiliency to allow the container 40 to be lowered to a point beneath the lower surface 13*b* of the print head, so as to facilitate both removal and insertion of a container 40 from the bracket assembly 30.

As was mentioned hereinabove, the vertically-aligned recess portion 37*b* assures that the container wick 44 is appropriately aligned beneath the print head wicks 74, 75 (to be more fully described). It should further be noted that upward movement of the container 40 is also limited by the under surface 13*b* of the print head nose cone portion 13, further upward movement being terminated when the top surface 41*e* of container 40 engages the under surface 13*b* of nose cone 13.

The portion of the ink delivery system mounted within the print head 10 is shown best in FIGS. 2, 2*a*, and 2*b*, wherein print head nose cone portion 13 is provided with a hollow circular-shaped bore 13*c*, having a vertically-aligned central axis 13*c*-1 (FIG. 2). As can best be seen from FIG. 2*a*, vertically aligned bore 13*c* is aligned so that its longitudinal axis 13*c*-1 coincides with the center line 60 of the print wires, shown best in FIG. 2*a*. The print wires 12 extend forwardly from the electromagnet actuating assemblies 11 arranged at the rear of the print head 10 and are arranged along a vertically-aligned imaginary plane containing central axis 13*c*-1 and center line 60. The forward tips 12*a* of the print wires each extend through a circular-shaped opening 22*a* provided in the jewel bearing 22 arranged in the front end 13*d* of the print head nose cone 13.

Considering FIGS. 2 and 2*a* and especially FIG. 2*b*, the aforementioned print head wick members 74, 75 are mounted upon a wick holder 70, which member has a substantially cylindrical-shaped lower portion 71. A shoulder 71*a* is provided a spaced distance upwardly from the bottom 71*b* of cylindrical portion 71 and merges with a pair of upright, spaced parallel projections 72 and 73 integral with and extending upwardly from cylindrical portion 71. Upright projections 72 and 73 are comprised of a pair of flat surface portions 72*a* and 73*a* which cooperate with surface 71*a* and adjacent portions of hollow bore 13*c* for receiving and positioning a pair of ink absorber members 78 and 79, as will be more fully described in connection with FIGS. 2 and 2*a*.

The upright projections 72 and 73 have interior facing surfaces 72*b* and 73*b*, respectively, which are arranged in spaced, parallel fashion relative to one another to define a hollow gap space therebetween. The projection 72 and 73 are further provided with substantially semicircular-shaped grooves or recesses 72*c* and 73*c*, respectively. The hollow region between surfaces 72*b* and 73*b* extends downwardly through cylindrical portion 71 of the wick holder 70. The top surfaces 72*d*, 73*d* of upright projections 72, 73 cover the recesses 72*c*, 73c to limit the upward movement of the wicks 74, 75 in the wick holder 70.

The semicircular-shaped recesses 72c and 73c are each adapted to receive a print head wick element 74 and 75, respectively, as shown best in FIG. 2a. The print head wick elements 74 and 75 are substantially cylindrical elongated rod-like members, preferably formed of a bonded nylon material or a cellulose acetate material. The print head wicks 74 and 75 and the container wick 44 may of course be formed of any suitable material which exhibits satisfactory capillary action for delivering ink from the ink container 40 to the print wires 12, in a manner to be more fully described.

The print head wicks 74 and 75 are inserted through the openings or recesses 72c and 73c which extend to the bottom of cylindrical portion 71. Preferably an assembly tool 81, which is a substantially elongated rigid member having a rectangular-shaped cross section, shown at 81a, is positioned within the gap space defined by surfaces 72b and 73b so as to be arranged between the wick members 74 and 75 to thereby urge wick members 74 and 75 into their associated recesses 72c and 73c, respectively.

The lower cylindrical portion 71 of wick holder 70 is provided with a locator projection 71b-1 which is adapted to be slidably received by cooperating locator groove 13c-1 at the rear of bore 13c to properly align the gap space between surfaces 72b, 73b with the print wires 12 so that the print wires 12 do not rub against projections 72, 73.

A pair of porous sponge-like ink absorber members 78 and 79, which are elongated members of substantially rectangular cross-section and preferably formed of a cellulose material, are vertically aligned so that their lower ends 78a and 79a rest upon surface 71a and so that one of their long sides rests against an associated one of the surfaces 72a and 73a when assembled, as will be more fully described. Initially, the wick members 74 and 75 are positioned in the recesses 72c, 73c in the wick holder 70 in the manner described, the wick holder 70, together with the assembly tool 81, is inserted into the bottom end of hollow bore 13c and is moved in the upward direction.

The wick holder 70 is angularly oriented so that the gap space between surfaces 72b and 73b is aligned with the print wires 12, enabling the print wires to move into the aforesaid gap space as the wick holder 70 is moved upwardly through hollow bore 13c. The upward movement of the wick holder 70 causes the lowermost print wire to be urged against the top 81a of assembly tool 81, causing the tool 81 to be prevented from entering into hollow bore 13c, thereby urging the tool out of the wick holder 70 and hence out of the bore 13c. This is obviously desirable, since the only function to be performed by the assembly tool 81 is to serve as a means for retaining the print head wicks 74 and 75 within their respective recesses 72c and 73c, so as to assure their proper alignment on opposite sides of the print wires 12 when assembled into the print head nose cone 13.

The wick holder 70 is inserted into hollow bore 13c until at least the top portion thereof extends to a position just slightly above the upper surface 13e of nose cone 13. Further upward movement is limited as a result of engagement of the top surfaces 72 and 73d of upright projections 72 and 73 with a recess in the paper guide member 90, to be more fully described.

As was mentioned hereinabove, the absorber members 78 and 79 are formed of a porous sponge-like material, such as, for example, a compressed cellulose sponge material. The absorber members 78 and 79 are inserted downwardly into the top end of hollow bore 13c in the dry, compressed state. When wetted with ink, the material is adapted to expand to a ratio of the order of 12 to 1, the expansion being from front to back, as shown by double-headed arrows 83 in FIG. 2a. The absorber members 78, 79 experience an insignificant amount of expansion in the direction perpendicular to said double-headed arrows 83. Thus, the absorber members 78 and 79 undergo additional compression when wetted (in a manner to be more fully described), whereby the absorber members 78 and 79 absorb ink delivered thereto by the print wires 12 and hold the ink for the print wires 12 which wipe small amounts of the ink onto the members 78, 79 as the print wires 12 oscillate back and forth during printing. The absorbers 78 and 79 preferably do not touch the container wick 44. However, the clearance space provided between the surfaces 72b and 73b and the outer surfaces of the print wires 12, in order to prevent undesirable wearing of either the print wires 12 or the wick holder 70 allows the absorber members 78, 79 to enter into this clearance space and possibly even touch wicks 74, 75, to aid in the migration of ink from wicks 74, 75 to absorber members 78, 79. The absorber members 78 and 79 hold an additional amount of ink over and above the amount that the print head wicks 74 and 75 are capable of delivering to the surfaces of the print wires 12 at the time that the print wires 12 begin movement so as to act as an auxiliary ink reservoir. This, in turn, permits the printer to print at higher speeds than would normally be possible if the absorbers were not utilized. Another significant function of the absorbers 78 and 79 is to keep the ink from migrating rearwardly along the wires and into the print head electromagnets 11. Also, the absorbers 78 and 79 prevent the ink in the region of the jewel bearing 22 and in the region of the print head wicks 74 and 75 from splashing or dripping upon the print receiving medium 15 either during movement of the print head 10 or when the printer is idle, even over a long period. To eliminate seepage of the ink from the print head 10 during periods when the printer is idle, it is preferable to use a water-based ink.

As was mentioned hereinabove, upward movement of the wick holder 70 results from the fact that the top surface of the container wick 44 is urged against the bottom ends of the print head wicks 74 and 75, as a result of the force imparted to container 40 by spring member 36. The intimate contact between the engaging surfaces of container wick 44 and print wicks 74 and 75 assures good migration of ink from container wick 44 to the print head wicks 74 and 75.

The paper guide member 90, shown best in FIGS. 2 and 4, comprises a frame-shaped portion 91 having a central opening 91a surrounded by a rectangular-shaped paper engaging surface 91b having recesses 91c and 91d. The frame 91 tapers outwardly and to the rear of the paper engaging surface 91b. The recesses 91c and 91d have a height which is slightly greater than the height of a line of characters being printed, as shown best in FIG. 4 to prevent smearing of the characters just printed. The paper guide 90 is further provided with a rearwardly-extending substantially U-shaped shell portion 93 integral with frame portion 91 and having a pair of openings 93a which are adapted to be aligned with a pair of cooperating and vertically-aligned openings 13g in nose cone 13. With these openings 93a and 13g in alignment, suitable threaded fasteners (not shown) are inserted into openings 93*a*, 13*g* so as to threadedly engage openings 13*g* and thereby secure paper guide assembly 90 to nose cone 13. With paper guide 90 mounted upon nose cone 13 in the manner described, there is an additional spacing provided between the front surface of jewel bearing 22 and the surfaces of recesses 91*c* and 91*d* in order to be assured that a fold in paper 15, which may, for example, be of the fanfold type, will engage the surfaces of recesses 91*c*, 91*d* but which is prevented from even slightly engaging the front surface 22*b* of jewel bearing 22 in order to prevent any ink which may have collected upon the front surfaces of the print wires 12 or bearing 22 from being transferred to the paper web 15 to cause unsightly smudging or smearing. The frame-shaped web engaging surface portion 91*b* of the paper guide assembly 90 is preferably polished to a smooth finish and is formed of a material having a low coefficient of sliding friction as it glides upon the web 15, to impose minimal drag upon the print head 10 and its carriage assembly 18 as these members are oscillated back and forth during printing. The paper guide 90 is preferably formed of a plastic material plated with a high wear-resistant metal to provide a long-lasting guide means. Alternatively, the paper guide 90 may be formed of a high wear-resistant metal.

The manner in which the print head and ink delivery means operate is as follows:

The container wick 44 is fully saturated with ink, which ink is carried upwardly through the container wick 44 by capillary action. The ink is carried further upwardly by capillary action through the print head wicks 74 and 75, whose inner surfaces engage the side surfaces of the reciprocating print wires 12. The total cross-sectional area of wicks 74, 75 is less than the cross-sectional area of container wick 44 to enhance the upward capillary flow of the ink. The container wick 44 and/or the print head wicks 74, 75 may be either tapered or of having sections of reduced diameters to enhance upward capillary flow. Note FIG. 3*d*, for example, which shows the container wick 44 as comprised of sections 44', 44'', 44''' of progressively reduced diameters, which arrangement greatly enhances upward delivery of ink as the total vertical height which the ink must be lifted increases. It should be noted that wicks 74, 75 may be staggered or tapered in a similar manner. The reciprocating print wires 12 slideably engage the surfaces of the print head wicks 74 and 75, causing some of the ink to be deposited thereon. Eventually the ink covers the exterior surface of each of the print wires 12. The ink is carried forwardly, and some of the ink is transferred to the absorber members 78 and 79, due to the sliding engagement between the side surfaces of the ink absorber members 78 and 79 engaging the print wires 12. The ink continues to move forwardly and passes by capillary action into the region defined by the exterior surfaces of the print wires 12 and the interior surfaces of the openings 22*a* provided within jewel bearing 22, which annular space, although small, is nevertheless sufficient to permit, and in fact promote, the migration of ink therethrough. The ink continues to move along the cylindrical surfaces of the print wires 12 and enters upon the substantially flat circular-shaped printing tips 12*a* of the print wires 12.

The ink delivered to the forward printing tips 12*a* is transferred to the print-receiving medium, i.e., paper web 15 shown in FIG. 4, which ink forms a circular dot conforming to the cross-sectional configuration of the print wire 12 which has just impacted the print-receiving medium 15. The print-receiving medium 15 is preferably supported by a platen 16. The ink removed from the forward tips of the print wires 12, due to the impacting of the print wires 12 against the print-receiving medium 15, is replaced by ink moving forwardly along the cylindrical surfaces of the print wires, the ink being moved forwardly in a continuous process.

The paper guide 90, shown best in FIGS. 2 and 4, is provided with a circular-shaped recess 93*f* which is adapted to receive the top ends of upright projections 72 and 73 of wick holder 70 in order to be assured that the wick holder 70 and hence the print head wicks 74 and 75 and absorber members 78 and 79 engage all of the print wires. A typical dot matrix print head is provided with either seven or nine print wires 12, depending upon the particular character resolution desired, although a greater or lesser number of print wires may be employed depending upon the particular printing application.

The ink absorbers 78 and 79 help maintain a constant ink supply to the print wires 12 and prevent excess ink from being delivered thereto in order to prevent ink from unnecessarily dribbling or splashing onto the print-receiving medium 15. The wick holder 70 maintains the wicks 74, 75 in proper alignment, as well as aiding in the delivery of ink to the print wires 12 and prolonging the dry-out cycle or evaporation of the ink, as well as preventing paper dust from collecting upon the print head wicks 74 and 75 and eventually clogging the ink delivery system through ink saturation of the dust particles. The wick holder 70 further simplifies and facilitates assembly and disassembly of print head wicks 74 and 75 and the absorber members 78 and 79 in print head nose cone 13. It should further be noted that the disposable ink container 40 and the wick holder 70, print head wicks 74 and 75, and the absorber members 78 and 79 can all be replaced without having to move the print head 10 in any way, thereby enabling the print head 10 to be maintained in precise alignment relative to the platen 16 and print-receiving medium 15.

As the print head 10 moves, the paper guide assembly 90 deflects any portion of the paper which may be loosely arranged on the platen 16 so as to assure that the paper 15 is smoothed before the print head 10 prints thereon.

The spring-biased container mounting 30 assures proper positioning of the wick holder 70, the print head wicks 74 and 75, and the absorber members 78 and 79, as well as assuring proper alignment of the container wick 44 and print head wicks 74 and 75 while further assuring good intimate engagement between their adjacent ends to insure upward feeding of the ink through the interstices of the wick elements 44, 74, and 75 by capillary action. The spring-loading arrangement further facilitates both removal and replacement of the container 40, the wick 70, and the elements 74, 75, 78, and 79 supported thereby.

The print head nose cone 13 and bearing 22 are preferably formed of a material which is not wetted by the ink so as to reduce or eliminate the need for cleaning of said members.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. Printing means for forming a pattern upon a print-receiving medium comprising:

a reciprocally-mounted elongated printing member and driving means normally maintaining said printing member in a first position with the printing tip of said printing member displaced from said print-receiving medium and for urging said printing member in a first direction to cause said printing tip to engage said print-receiving medium when said driving means is activated;

guiding means guiding the forward end of said elongated printing member to freely enable the reciprocating action of said printing member, said guiding means having a bore, said bore having a contour substantially conforming to the cross-sectional configuration of the printing member which is guided by said bore;

ink supply means removably mounted below said printing member;

slender elongated wick means comprising at least one wicking member extending between said ink supply means and said elongated printing member for supplying ink from said ink supply means upwardly by capillary action through said wick means and upon a longitudinal surface of said elongated printing member which slidably engages said wick means as the elongated printing member undergoes said reciprocating action, whereby ink is transferred to a portion of the longitudinal surface of the printing member which enters into said bore when said driving means is actuated; and slender elongated absorber means formed of a porous, highly absorbent material positioned between said wick means and said guiding means and displaced from said ink supply means; said absorber means being slidably engaged by said elongated printing member as the elongated printing member experiences said reciprocating action, said absorber means being arranged to absorb ink derived from said wicking means and transferred thereto by said elongated printing member to regulate the flow of ink along said elongated printing member delivered by said wick means toward the printing tip thereof and to provide intermediate storage for ink which enables printing to occur even after said ink supply means is exhausted.

2. The printing means of claim 1, wherein said printing member is an elongated resilient metallic wire and said driving means is a print wire driving electromagnet assembly.

3. The printing means of claim 2, wherein said guiding means comprises a bearing member having a low coefficient of friction for receiving and guiding said print wire;

said bearing member being adapted to minimize the amount of wearing experienced by both said print wire and said bearing member due to the reciprocating action of said print wire.

4. The printing means of claim 1, wherein said ink supply means comprises a ink container removably positioned beneath said printing member;

a container wick positioned within said ink container and being saturated with the ink of said container; and the upper end of said container wick being urged against the lower end of said wick means, whereby ink is delivered from said container by capillary action through said container wick and said wick means to said printing member.

5. The printing means of claim 4, wherein said wick means comprises first and second slender elongated printing member wicks arranged in spaced, parallel fashion on opposite sides of said printing member and having their lower ends in intimate contact with the upper end of said container wick to facilitate the transfer of ink by capillary action from said container wick and said printing member wicks to said elongated printing element.

6. The printing means of claim 1, wherein said ink supply means comprises a disposable container;

means for releasably positioning and supporting said disposable container beneath said printing element; and means arranged between said container and said holding means for resiliently urging said container upwardly towards said printing element.

7. The printing means of claim 1, further comprising a paper guide member positioned upon said guiding means and having a forward surface extending beyond the forward surface of said guiding means for slideably engaging said print-receiving medium in order to maintain said print-receiving medium displaced from the forward surface of said guiding means and from the printing tips of said elongated printing member when said printing member is in said first position to thereby prevent the undesirable transfer of ink from said printing member to said print-receiving medium as long as said elongated printing member is maintained in said first position.

8. A print head of the dot matrix type comprising:

a plurality of reciprocally-mounted elongated resilient slender print wires having forward and rearward ends;

resilient means for normally urging said print wires in a first direction toward a rest position;

solenoid driving means for each of said print wires adapted to urge their associated print wires in a first direction away from said rest position and toward a print-receiving medium;

a print wire housing for housing and reciprocally mounting said print wires;

print wire guiding means arranged in the forward end of said housing for maintaining the forward ends of said print wires in a predetermined alignment and including a plurality of guide holes, each hole being adapted to slidably receive and guide an associated reciprocating print wire, the shape of each hole substantially conforming to the cross-sectional configuration of the print wire received and guided therein;

a hollow wick receiving bore extending through said housing, the longitudinal axis of said hollow bore being aligned substantially transverse to the direction of movement of said print wires;

a pair of slender elongated wick members being arranged in said bore on opposite sides of said print wires;

a pair of slender elongated absorber members being arranged in said bore between said wick members and said guiding means and being positioned on opposite sides of said print wires and being wipingly engaged by said print wires;

removable holder means extending into said bore and being adapted to maintain said wick members and said absorber members in substantially spaced, parallel alignment and cooperating with said bore for maintaining the sides of said wick members in sliding engagement with said print members and for maintaining the sides of said absorber members in sliding engagement with said print wires; and liquid ink supply means removably positioned beneath said print head housing and means in said ink supply means communicating with the lower ends of said wicks for delivering ink to the lower ends of said wicks, whereby said wicks deliver ink to the engaging surfaces of said print wires by capillary action.

9. The printing means of claim 8 wherein said absorber members are formed of an absorbent material adapted to swell when wetted by the ink to serve as a means for regulating the amount of ink delivered to the forward tips of the print wires.

10. The printing means of claim 8, further comprising insertion tool means being adapted to be releasably inserted through said holder means so as to maintain said wick members in spaced, parallel fashion in said holder means preparatory to insertion into the wick receiving bore of said print head housing.

11. The apparatus of claim 8, further comprising paper guide means mounted upon the forward end of said print head housing and surrounding said guiding means;

said paper guiding means being provided with a frame portion surrounding said print wire guiding means and adapted to slideably engage said print-receiving medium so as to maintain the print-receiving medium displaced a predetermined distance from the adjacent surface of said print wire guiding means to prevent ink collected along the forward surface of said print wire guiding means from being transferred to said print-receiving medium when said solenoid driving means are not activated.

12. The apparatus of claim 10, wherein said frame portion is provided with a pair of recesses on opposite sides of said print wire guiding means to prevent ink transferred to said print-receiving medium by said print wires from being smeared by said paper guiding means.

13. The printing means of claim 8, further comprising bracket means for receiving and supporting said ink supply means;

said bracket means having a supporting portion for receiving and supporting said ink supply means;

resilient biasing means arranged upon said supporting portion for urging said ink supply means upwardly and toward said print head housing;

said ink supply means having a guide projection along one surface thereof to aid in mounting of the ink supply means relative to said print head;

said ink supply means supporting portion having L-shaped guiding and alignment means for slideably receiving said guide projection, said L-shaped guiding and alignment means having a horizontally-aligned leg merging with a vertically-aligned leg;

said ink supply means having an outlet opening along the upper end thereof, whereby said outlet opening is positioned immediately beneath the wick receiving bore in said print head housing when said guide projection is positioned within the vertically-aligned leg of said L-shaped guiding means whereby said resilient spring means urges said supply container upwardly towards said print head.

14. The apparatus of claim 13, wherein said supply container is provided with vertically-aligned wick means;

the upper end of said vertically-aligned wick means engaging the lower ends of the wicks arranged in said wick receiving bore, said resilient spring means urging the adjacent end of said container wick and said print head wick members into intimate engagement.

15. The apparatus of claim 13, wherein said paper guide means is provided with a portion extending rearwardly from said print wire guiding means so as to overlie the upper end of said vertially-aligned bore, thereby limiting the upward movement of said holder means through said wick receiving bore to thereby assure proper alignment of said wick members and said absorber members relative to said print wire members.

16. The apparatus of claim 8, wherein said wick members are formed of a nylon fiber.

17. The apparatus of claim 8, wherein said absorber members are formed of a compressed cellulose sponge material adapted to experience significant expansion when wetted.

18. The apparatus of claim 8, wherein the wick in said supply container is formed of a compressed cellulose acetate material.

19. The apparatus of claim 8 wherein said absorber members are formed of a compressed sponge-like absorbent material adapted to swell to more than double its size when wetted, said swelling being confined to the direction parallel to the direction of movement of said print wires so as to become firmly wedged between said wick holder and said bore.

20. The apparatus of claim 8 wherein said wick receiving bore is provided with a locator recess along one portion thereof; and said wick holder having a locator projection slidably received in said locator recess to properly align said wick holder in said bore.

21. The apparatus of claim 12 wherein the front surface of said guiding means is displaced rearwardly from the surfaces of said recesses to prevent folds in the print receiving medium from engaging the surface of said guiding means.

22. The apparatus of claim 11 wherein said paper guide means is formed of a high wear-resistant metallic material.

23. The apparatus of claim 11 wherein said paper guide means is formed of a plastic material plated with a high wear-resistance metallic material.

24. The apparatus of claim 1 wherein said ink supply means contains a water-based ink to significantly reduce seepage of ink during periods when the printing means is idle.

25. The apparatus of claim 8 wherein said housing and said guiding means are formed of a material which inhibits wetting of said members by the ink to reduce the need for cleaning.

26. The apparatus of claim 8 wherein said print head wicks is less than the cross-sectional area of said container wick.

27. The apparatus of claim 8 wherein said container wick is an elongated tapered member having a large bottom cross-section tapering to a smaller top cross-section.

28. The apparatus of claim 8 wherein said print head wicks are elongated tapered members each having a large bottom cross-section tapering to a smaller top cross-section.

29. The apparatus of claim 13 wherein said resilient biasing means comprises a leaf spring member having a substantially flat central portion and downwardly depending arms integral with said central portion, said central portion being adapted to bend into a curved configuration and said arms being adapted to bend outwardly when said ink supply means is positioned in said supporting portion; and the leaf spring being bent at the points where said arms join said central portion, said bends being engaging the bottom of said ink supply means to maintain the ink supply means substantially level.

30. The apparatus of claim 29 wherein the free ends of said arms embrace said supporting portion when said ink supply means is removed from said supporting portion.

* * * * *